US005577405A

United States Patent [19]

Shore et al.

[11] Patent Number: 5,577,405

[45] Date of Patent: Nov. 26, 1996

[54] SINGLE STRAND BLOCK-TYPE ROLLING MILL

[75] Inventors: Terence M. Shore, Princeton; Harold E. Woodrow, Northboro, both of Mass.

[73] Assignee: Morgan Construction Company, Worcester, Mass.

[21] Appl. No.: 579,915

[22] Filed: Dec. 28, 1995

Related U.S. Application Data

[63] Continuation of Ser. No. 171,649, Dec. 22, 1993, abandoned.

[51] Int. Cl.[6] ..... B21B 31/06

[52] U.S. Cl. ..... 72/235; 72/249

[58] Field of Search ..... 72/234, 235, 237, 72/238, 239, 249

[56] References Cited

U.S. PATENT DOCUMENTS

| | | | |
|---|---|---|---|
| 1,412,261 | 4/1922 | Reimann | 72/249 |
| 3,945,234 | 3/1976 | Steinbock | 72/235 |
| 4,537,055 | 8/1985 | Woodrow et al. | 72/249 |
| 4,744,234 | 5/1988 | Poloni | 72/235 |

FOREIGN PATENT DOCUMENTS

| | | | |
|---|---|---|---|
| C-970102 | 8/1958 | Germany . | |
| A-1452139 | 5/1969 | Germany . | |
| B-2119389 | 10/1972 | Germany . | |
| 231022 | 12/1985 | Germany | 72/235 |
| 179208 | 10/1984 | Japan | 72/235 |

*Primary Examiner*—Lowell A. Larson
*Assistant Examiner*—Thomas C. Schoeffler
*Attorney, Agent, or Firm*—Samuels, Gauthier, Stevens & Reppert

[57] ABSTRACT

A single strand block-type rolling mill has pairs of oppositely inclined work rolls arranged successively along a mill pass line to roll rod and bar products in a twist-free manner. A planar base structure extends in parallel relationship beneath the mill pass line. A plurality of housings are arranged seriatim along the mill pass line. The housings are secured to the base structure and have mutually overlapping portions secured to one another. Each housing includes intermediate drive components for driving a pair of roll shafts carrying one of the work roll pairs, with the intermediate drive components being mechanically coupled to each other and to a common mill drive.

6 Claims, 4 Drawing Sheets

SINGLE STRAND BLOCK-TYPE ROLLING MILL

This is a continuation of application Ser. No. 08/171,649 filed on Dec. 22, 1993, abandoned.

BACKGROUND OF THE INVENTION

1. Field of the Invention

This invention relates generally to rolling mills, and is concerned in particular with an improved single strand block-type mill for rolling products such as bars, rods and the like in a twist-free manner.

2. Description of the Prior Art

Typical examples of conventional single strand block-type rolling mills are shown in U.S. Pat. Nos. Reissue 28,107 (Wilson et al) and 3,610,014 (Weber). In these mills, the successive roll stands, which each include a bevel gear housing carrying a removable roll package, are located on a common side of the mill pass line. This requires a rather complicated and heavy base structure which adds significantly to the overall cost of the mill.

Other mill designs, such as for example those described in German Pat. No. 970,102(granted 21 August 1958) and in the September 1958 issue of Iron and Steel Engineer at pages 65–67, have opted for a different "X" type arrangement, where successive mill stands are alternatively arranged on opposite sides of the pass line. These mills mount the roll stands on the sloping faces of inverted V-shaped support pedestal. Some cost savings can be achieved with this type of base structure. However, other problems, including lack of vertical and longitudinal compactness, lack of sufficient structural rigidity, and a high noise level attributable to sound reverberation within the enclosed space underlying the support pedestal, more than offset any cost saving, thereby rendering such designs impractical for most commercial applications.

Still another mill design is disclosed in U.S. Pat. No. 4,537,055 (Woodrow et al). Here, the gear housings are carried on a base structure comprising a weldment made up of a flat vertically upstanding structural member standing on edge and joined to an underlying base plate in a generally inverted "T" configuration. The structural member extends beneath and in parallel relationship to the mill pass line. Reinforcing rib members extend laterally away from and are spaced along opposite sides of the structural member. The rib members are joined on edge to both the structural member and the base plate and have upper support edges on which the gear housings are secured.

SUMMARY OF THE INVENTION

An objective of the present invention is the provision of a single strand block-type mill having an improved base structure which is simpler in design as compared with the base structures of the conventional mills described above.

A companion objective of the present invention is the provision of a base structure which coacts in mechanically interlocked engagement with the gear housings of the mill, the latter being in additional coactive mechanical interengagement with each other to provide a rigid structure capable of withstanding the high stresses experienced during rolling.

These as well as other objectives and advantages to be described hereinafter in greater detail, are realized by the incorporation into the mill design of a planar base structure extending horizontally beneath and parallel to the mill pass line. The base structure preferably comprises a unitary plate of rectangular cross section machined on its upper surface, with its underside grouted onto an underlying concrete foundation.

The gear housings of the mill are arranged seriatim along and alternatively on opposite sides of the mill pass line. Each housing has a machined vertical surface coinciding with the center line of the mill, and a machined horizontal undersurface. Each housing is bolted down onto the support base and also to its immediate neighboring housing at a location of overlap therebetween.

By virtue of this assembly, a rigid structure is achieved even though the planar base has a relatively low initial stiffness prior to being assembled with the mill housings.

A preferred embodiment of the invention will now described in greater detail with reference to the accompanying drawings, wherein:

DESCRIPTION OF PREFERRED EMBODIMENT

Figure 1:
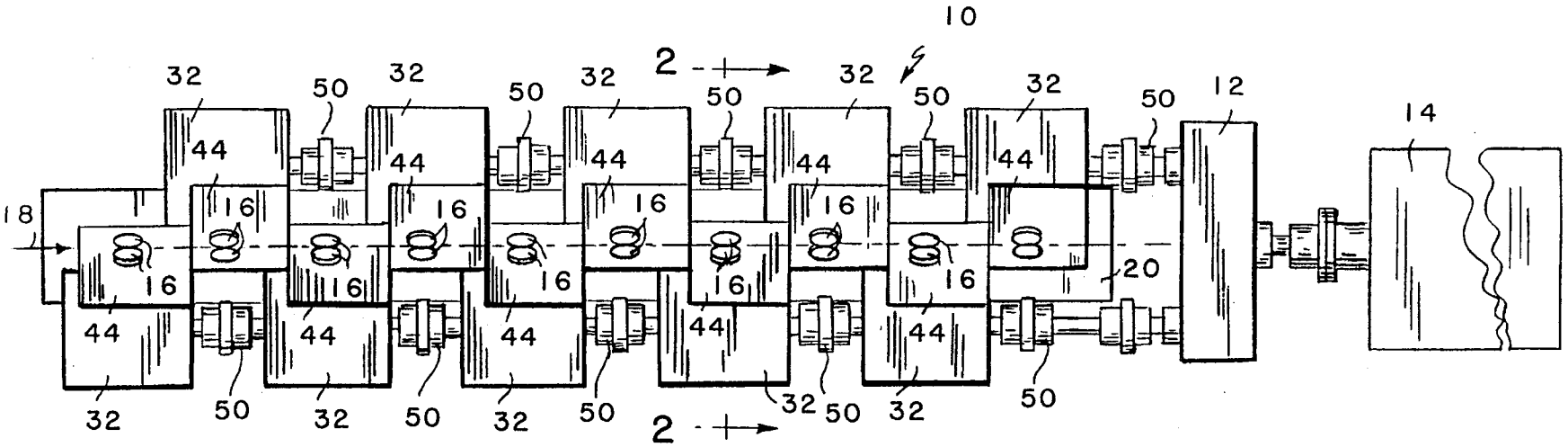
FIG. 1 is a plan view of a single strand block-type mill in accordance with the present invention.

Referring initially to FIG. 1, a rolling mill in accordance with the present invention is shown at 10. The mill is connected via a conventional gear-type speed increaser 12 to a primary drive motor 14.

Figure 2:
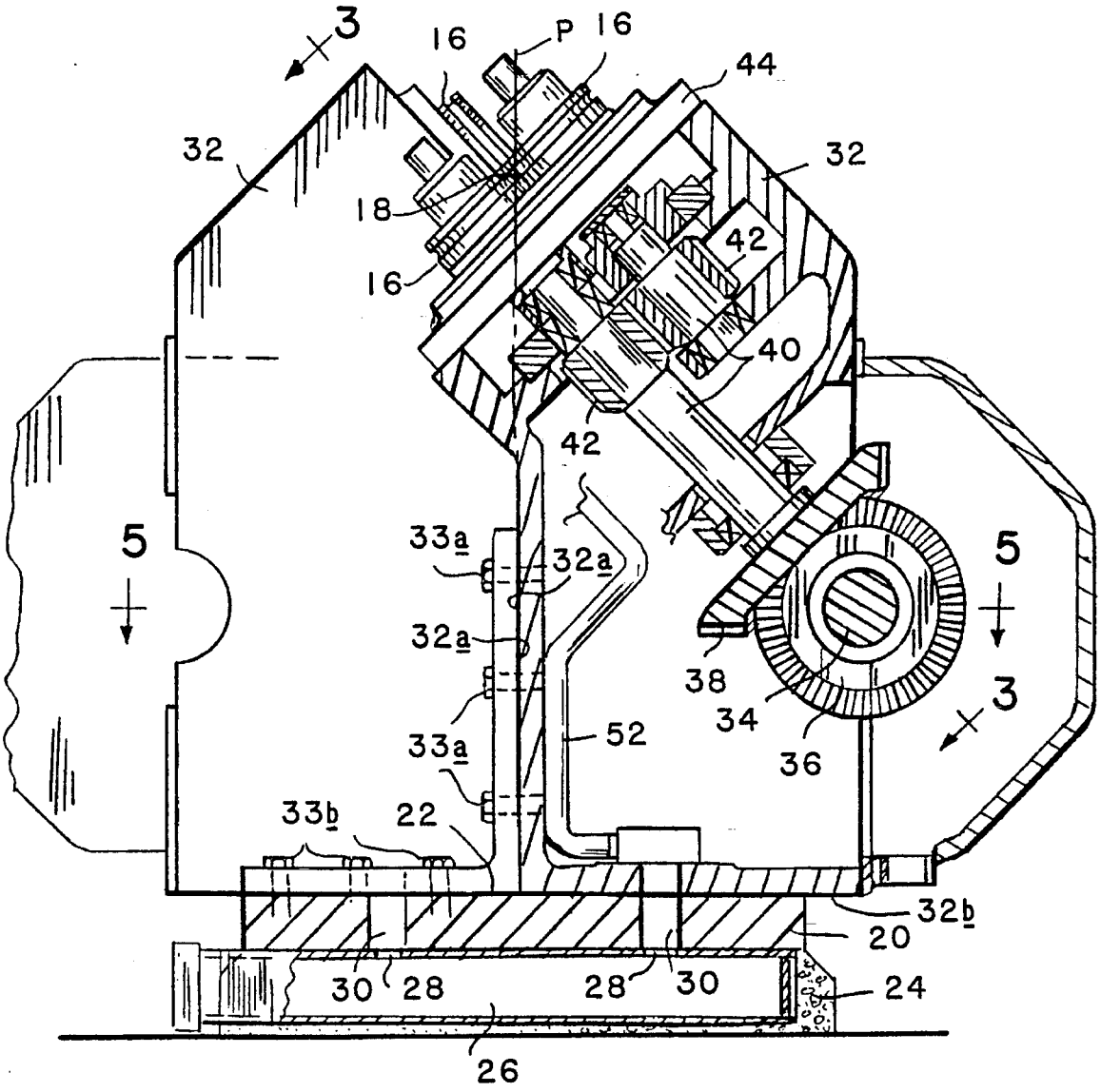
FIG. 2 is a cross sectional view on an enlarged scale taken along line 2—2 of FIG. 1.
Figure 3:
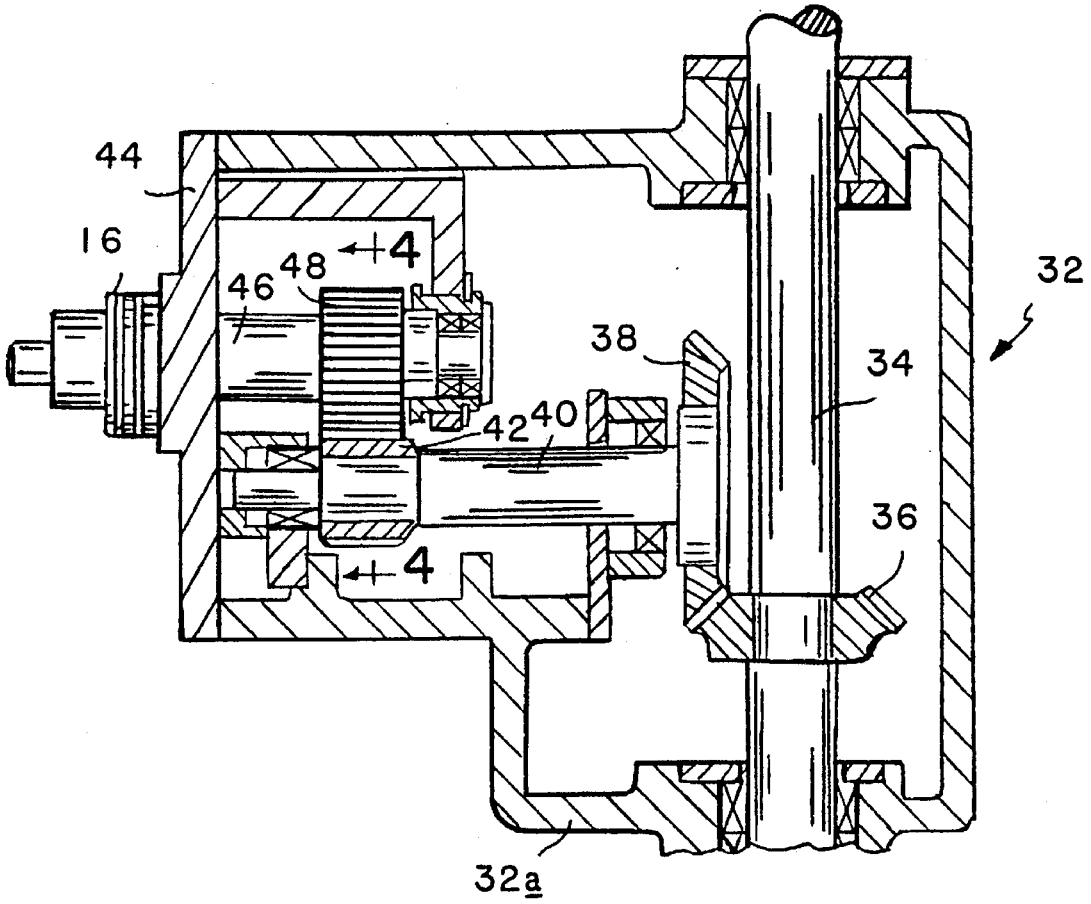
FIG. 3 is a sectional view taken along line 3—3 of FIG. 2.

With reference additionally to FIGS. 2 and 3, it will be seen that the mill 10 has successive pairs of work rolls 16 arranged along the mill pass line 18. The roll axes of successive roll pairs are offset by 90° to thereby allow the product to be rolled in a twist free manner.

The mill includes a planar base structure which preferably comprises a plate 20 extending beneath and in parallel relationship to the mill pass line 18. Plate 20 has a rectangular cross sectional configuration having a flat machined upper surface 22 and an underside grouted onto an underlying concrete foundation 24. The foundation 24 may be recessed at appropriate locations to receive square lubricant supply tubes 26 welded to the underside of plate 20. The supply tubes communicate as at 28 with strategically positioned connecting apertures 30 in the support plate 20, the purposes of which will be described hereinafter.

The rolling mill 10 includes a plurality of gear housings 32 arranged seriatim along the mill pass line 18. Each gear housing includes a machined vertical surface **32*a* coinciding with a reference plane (P) containing the mill pass line 18, and a machined horizontal undersurface 32*b* supported on the machined upper surface of plate 20**.

The housings 32 are arranged consecutively along and alternatively on opposite sides of the mill pass line 18, with mutually overlapping portions abutting one another at interfaces lying on the reference plane P. The overlapping housing portions are secured one to the other by bolts **33*a*, and the housings are additionally secured to the underlying support plate 20 by bolts 33***b*.

It will be appreciated that although the support plate 20 has low initial stiffness, once incorporated into the overall assembly with the interconnected housings 32, the resulting structure has ample rigidity and stiffness.

Each gear housing 32 contains a line shaft segment 34 carrying a driving bevel gear 36 which meshes with a driven bevel gear 38 on one of a pair of intermediate drive shafts 40. The intermediate drive shafts carry intermeshed gears 42.

Figure 4:
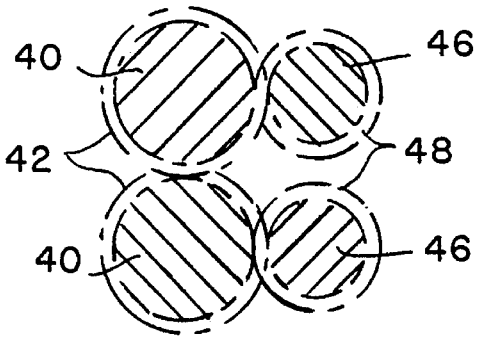
FIG. 4 is a sectional view taken along line 4—4 of FIG. 3.
Figure 5:
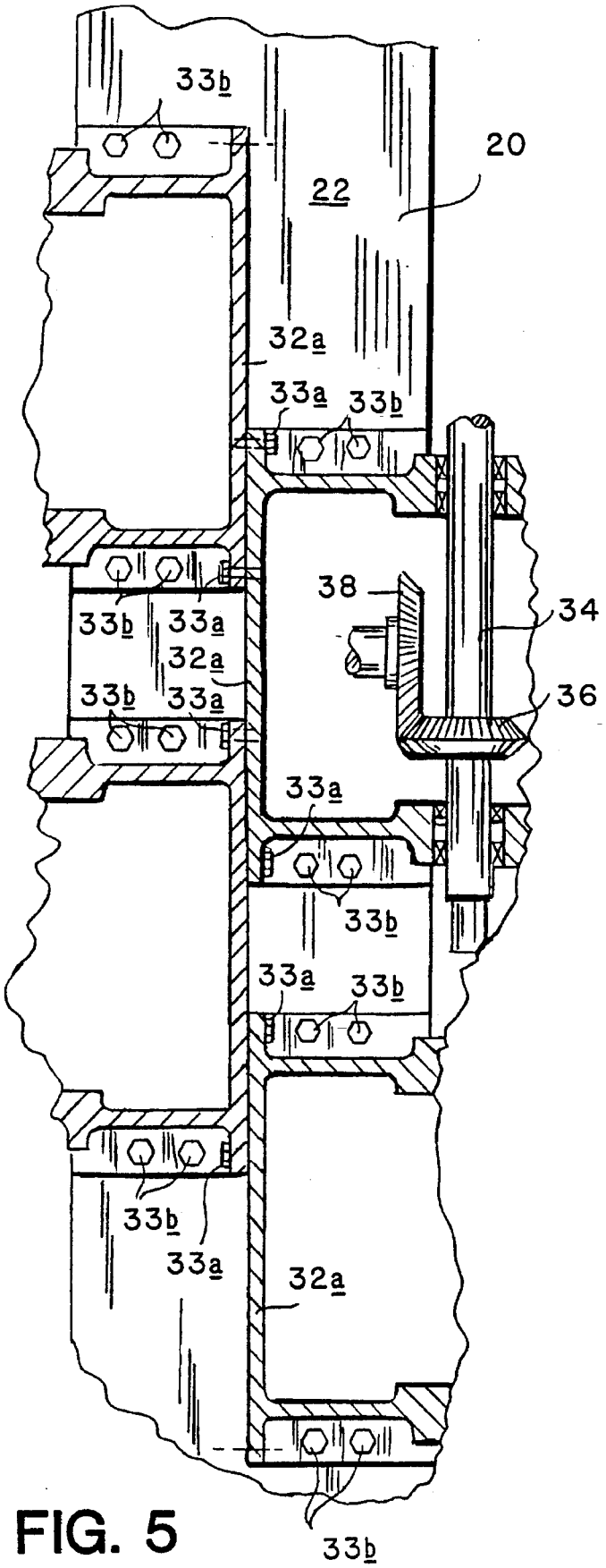
FIG. 5 is a sectional view taken along line 5—5 of FIG. 2.

Roll packages 44 are carried by the gear housings 32. Preferably, the roll packages are at least partially received within the upper portions of the gear housings 32. Each roll package has a pair of roll shafts 46 on which the work rolls 16 are mounted. The roll shafts each carry gears 48 which are separated from each other, and which mesh individually with the intermeshed gears 42 on the intermediate drive shafts 40, all as shown in FIG. 4. Although not shown, it will be understood that means similar to that shown in U.S. Pat. No. Reissue 28,107 (Wilson et at.) are provided for adjusting the parting between the work rolls of each pair. The line shaft segments 34 are interconnected by couplings 50. The interconnected line shaft segments are driven via the speed increaser 12 by the primary drive motor 14. The openings 30 in the base plate 20 may conveniently be connected to prepositioned internal lubrication piping 52, thereby facilitating the task of settling up the mill.

In light of the foregoing, it will now be appreciated by those skilled in the art that the base structure of the present invention is remarkably simple in design as compared to those of the prior art mill arrangements currently in use. Although the base structure preferably consists of a unitary flat plate, a potentially acceptable alternative would be the provision of an appropriately configured planar weldment providing a flat machined top surface on which the housings 32 may be conveniently secured.

The overlapping interlocked relationship of the housings coacts with the underlying planar support structure to provide an overall rigidity at least equal to that of prior art structures, while at the same time making it possible achieve important savings in overall costs.

We claim:

1. A single strand block-type rolling mill having pairs of oppositely inclined work rolls arranged successively along a pass line to roll product in a twist-free manner, comprising: a planar base structure extending in parallel relationship to the pass line; a group of housings arranged seriatim along the pass line, successive housings of said group having mutually overlapping portions which contact each other at interfaces extending in the direction of said pass line, means for interconnecting the successive housings of said group at the interfaces of their mutually overlapping portions, wherein said mutually overlapping portions are secured to one another at interfaces lying on a common reference plane containing said pass line and means for connecting said housings to said base structure, each of said housings including intermediate drive means for driving a pair of roll shafts carrying one of said pairs of work rolls, said intermediate drive means being mechanically coupled to each other and to a common mill drive.

2. The rolling mill of claim 1 wherein said base structure extends horizontally beneath said pass line.

3. The rolling mill of claim 2 wherein said reference plane is perpendicular to said base structure.

4. The rolling mill according to any one of claims 1, 2 and 3 wherein said base structure comprises a plate member.

5. The rolling mill according to any one of claims 1, 2 and 3 wherein said housings are secured to said base structure alternatively on opposite sides of said pass line.

6. A single strand block-type rolling mill having successive pairs of work rolls arranged along a pass line to roll products in a twist-free manner, said rolling mill comprising: a base structure extending in parallel relationship to the pass line; a group of housings secured to said base structure and arranged seriatim along the pass line; successive housings of said group having interconnected mutually contacting portions which overlap each other at common interfaces extending in the direction of said pass line wherein said mutually contacting portions are interconnected at said interfaces and said interfaces lie in a common reference plane containing said pass line, each of said housings containing means for drivingly connecting one of said pairs of work rolls to a common mill drive.

* * * * *